US008344607B2

(12) United States Patent
Aoki et al.

(10) Patent No.: US 8,344,607 B2
(45) Date of Patent: Jan. 1, 2013

(54) ELECTRON-EMITTING DEVICE AND DISPLAY PANEL INCLUDING THE SAME

(75) Inventors: Naofumi Aoki, Chigasaki (JP); Shoji Nishida, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 518 days.

(21) Appl. No.: 12/627,893

(22) Filed: Nov. 30, 2009

(65) Prior Publication Data

US 2010/0134313 A1 Jun. 3, 2010

(30) Foreign Application Priority Data

Dec. 2, 2008 (JP) ..... 2008-307585
Oct. 7, 2009 (JP) ..... 2009-233503

(51) Int. Cl.
*H01J 1/00* (2006.01)
*H01J 19/06* (2006.01)

(52) U.S. Cl. ..... 313/311; 313/495; 313/309; 313/336; 313/346 R

(58) Field of Classification Search ..... 313/495–497, 313/309–311, 336, 351, 346 R
See application file for complete search history.

(56) References Cited

U.S. PATENT DOCUMENTS

| | | | | |
|---|---|---|---|---|
| 3,823,337 | A * | 7/1974 | van Stratum et al. | 313/346 R |
| 4,008,412 | A | 2/1977 | Yuito | |
| 4,663,559 | A * | 5/1987 | Christensen | 313/336 |
| 6,417,606 | B1 | 7/2002 | Nakamoto et al. | |
| 2004/0056580 | A1 * | 3/2004 | Nishibayashi et al. | 313/309 |
| 2004/0189176 | A1 | 9/2004 | Koga | |
| 2006/0238457 | A1 * | 10/2006 | Hu | 345/75.2 |
| 2006/0267475 | A1 * | 11/2006 | Visser et al. | 313/495 |
| 2008/0001513 | A1 * | 1/2008 | Chen et al. | 313/309 |
| 2008/0030117 | A1 * | 2/2008 | Chen et al. | 313/311 |
| 2008/0054790 | A1 * | 3/2008 | Kim et al. | 313/491 |
| 2010/0053126 | A1 * | 3/2010 | Kobayashi et al. | 345/204 |

FOREIGN PATENT DOCUMENTS

| | | | |
|---|---|---|---|
| JP | 1-235124 | A | 9/1989 |
| JP | 2-220337 | A | 9/1990 |
| JP | 03145030 | A | 6/1991 |
| JP | 05-198253 | A | 8/1993 |
| JP | 6-089651 | A | 3/1994 |
| JP | 6091190 | A | 3/1994 |
| JP | 7-037485 | A | 2/1995 |
| JP | 07-078553 | A | 3/1995 |
| JP | 7-078553 | A | 3/1995 |
| JP | 7-134940 | A | 5/1995 |

* cited by examiner

*Primary Examiner* — Anh Mai
*Assistant Examiner* — Kevin Quarterman
(74) *Attorney, Agent, or Firm* — Canon U.S.A., Inc. IP Division

(57) ABSTRACT

An electron-emitting device includes an electroconductive member and a lanthanum boride layer on the electroconductive member and further includes an oxide layer between the electroconductive member and the lanthanum boride layer. The oxide layer can contain a lanthanum element. The lanthanum boride layer can be overlaid with a lanthanum oxide layer.

18 Claims, 8 Drawing Sheets

ELECTRON-EMITTING DEVICE AND DISPLAY PANEL INCLUDING THE SAME

BACKGROUND OF THE INVENTION

1. Field of the Invention

The present invention relates to an electron-emitting device having a lanthanum boride layer and a display panel.

2. Description of the Related Art

In a general field-emission-type electron-emitting device, a voltage is applied between an electron-emitting member and a gate electrode to generate a strong electric field at the tip of the electron-emitting member, allowing the electron-emitting member to emit electrons into a vacuum.

In such a field-emission-type electron-emitting device, the electric field strength used for electron emission greatly depends on the work function of the surface of an electron-emitting member and its tip shape. It is theoretically believed that an electron-emitting member having a lower surface work function can emit electrons in a weaker electric field.

Japanese Patent Laid-Open No. 01-235124 and U.S. Pat. No. 4,008,412 disclose an electron-emitting device that has a surface layer formed of a low-work-function material, lanthanum hexaboride ($LaB_6$), on a tungsten or molybdenum emitter.

Japanese Patent Laid-Open No. 07-078553 discloses a field-emission microcathode.

A large number of field-emission-type electron-emitting devices can be arranged on a substrate (rear plate) to constitute an electron source. As in a cathode ray tube (CRT), an display panel can be fabricated by placing a substrate (face plate) that includes a light-emitting member, such as a fluorescent member, which emits light in response to electron beam irradiation, opposite the rear plate and sealing the peripheral space between the face plate and the rear plate.

In a conventional electron-emitting device, heat or another factor generated by sealing or operation (electron emission) may cause La in a $LaB_6$ layer to diffuse into an underlying structure formed of an electroconductive member, or may cause metal elements in the structure to diffuse into the $LaB_6$ layer. Such diffusion may interfere with the function of the low-work-function $LaB_6$ layer, thereby altering the electron emission characteristics of the electron-emitting device.

This situation is more noticeable in a polycrystalline $LaB_6$ layer than in a monocrystalline $LaB_6$ layer. This is possibly because the diffusion of metal elements contained in the structure into the $LaB_6$ layer and the diffusion of La contained in the $LaB_6$ layer into the structure occur through grain boundaries in a polycrystalline layer.

SUMMARY OF THE INVENTION

The present invention provides an electron-emitting device that includes an electron-emitting member and emits electrons from a surface of the electron-emitting member in an electric field. The electron-emitting member includes an electroconductive member and a lanthanum boride layer disposed on the electroconductive member, wherein an oxide layer is disposed between the electroconductive member and the lanthanum boride layer.

Further features of the present invention will become apparent from the following description of exemplary embodiments with reference to the attached drawings.

DESCRIPTION OF THE EMBODIMENTS

Embodiments of the present invention will be described below with reference to the drawings. It should be noted that, unless otherwise specified, the characteristics of components described in these embodiments, such as size, material, and shape, and their arrangements do not limit the scope of the present invention.

The terms "oxide of metal" and "metal oxide" are used herein interchangeably, and the metal may have any oxidation number. More specifically, an "oxide of metal" or a "metal oxide" is represented by "$MO_X$", wherein M denotes a metallic element and X denotes a positive numeral. The oxidation number may be specified by the expression "metal dioxide" or "$MO_2$", for example. For example, an "oxide of tungsten" or a "tungsten oxide" includes both "tungsten trioxide" and "tungsten dioxide". The same applies to substances other than metals (for example, semiconductors) and substances other than oxides (for example, borides).

Figure 1:
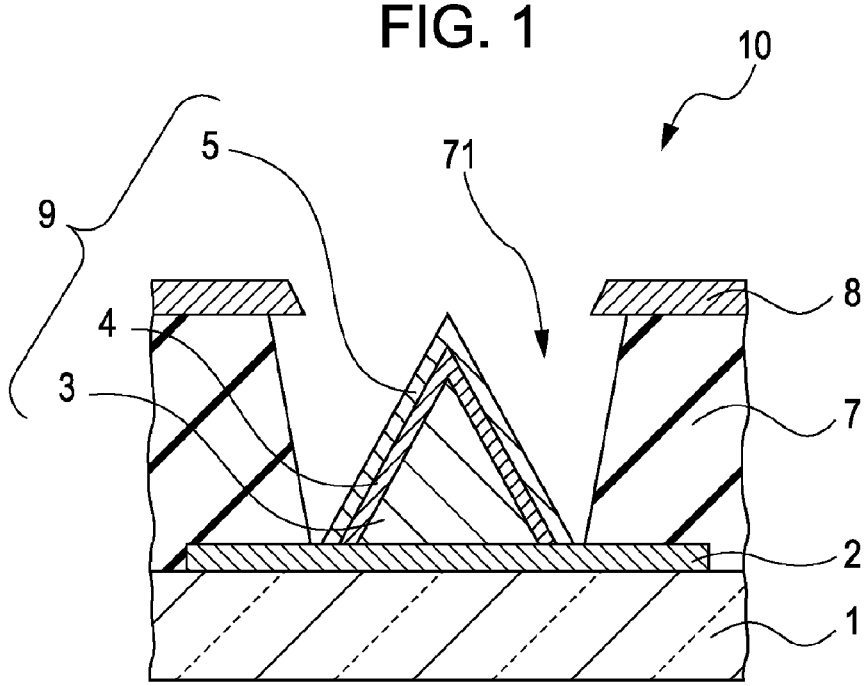
FIG. 1 is a schematic cross-sectional view of an electron-emitting device according to an embodiment of the present invention.

FIG. 1 is a schematic cross-sectional view of an electron-emitting device 10 according to the present embodiment. A cathode electrode 2 is disposed on a substrate 1 and is electrically connected to a structure 3 formed of an electroconductive member. The structure 3 may be formed of any electroconductive material, such as metal or semiconductor. The structure 3 is overlaid with an oxide layer 4, and the oxide layer 4 is overlaid with a lanthanum boride layer 5. In other words, the oxide layer 4 is disposed between the structure 3 and the lanthanum boride layer 5. The lanthanum boride layer 5 is formed of a boride of lanthanum ($LaB_X$). The structure 3, the oxide layer 4, and the lanthanum boride layer 5 constitute an electron-emitting member 9. Thus, the electron-emitting member 9 is electrically connected to the cathode electrode 2. An electron-emitting member 9 is often called "an electron-emitter" or "cathode".

Figure 2:
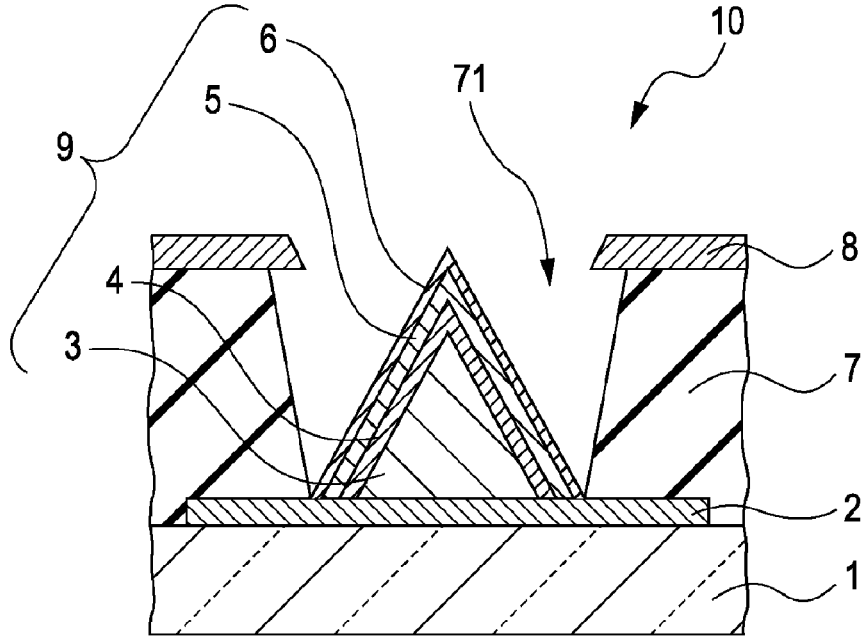
FIG. 2 is a schematic cross-sectional view of an electron-emitting device according to another embodiment of the present invention.

In FIGS. 1 and 2, the structure 3 formed of an electroconductive member has a conical shape. The structure 3 may also be formed of any electroconductive member having such a geometry that the electric field strength on the surface of the electron-emitting member 9, more specifically the surface of the lanthanum boride layer 5 and/or the surface of a lanthanum oxide layer 6 described below, can be increased.

The cathode electrode 2 is overlaid with an insulating layer 7, on which a gate electrode 8 is disposed. The structure 3 is disposed in a circular opening 71 in the insulating layer 7 and the gate electrode 8. Thus, the electron-emitting member 9 is also disposed in the opening 71. The opening 71 may be, but not limited to, circular or polygonal.

The electron-emitting device 10 can be driven by applying a predetermined voltage between the cathode electrode 2 and the gate electrode 8 such that the cathode electrode 2 has a lower electric potential than the gate electrode 8. The applied voltage depends on the distance between the electron-emitting member 9 and the gate electrode 8 and the shape of the electron-emitting member 9 (typically, the shape of the structure 3) and generally ranges from 20 to 100 V. Electrons are typically emitted in an electric field from the lanthanum boride layer 5, which forms the surface of the electron-emitting member 9. As described above, in such a field-emission-type electron-emitting device, the application of a voltage between a cathode electrode and a gate electrode generates a strong electric field between an electron-emitting member and the gate electrode, allowing the electron-emitting member to emit electrons in an electric field.

The oxide layer 4 between the structure 3 and the lanthanum boride layer 5 functions as a diffusion barrier layer. The oxide layer 4 can reduce the diffusion of metal or semiconductor elements contained in the structure 3 into the lanthanum boride layer 5 and the diffusion of La contained in the lanthanum boride layer 5 into the structure 3. The oxide layer 4 can therefore stabilize the operation of the electron-emitting device 10.

The oxide layer 4 is formed of an oxide of metal or an oxide of semiconductor. The oxide layer 4 can be formed of the metal or semiconductor component forming the structure 3. The oxide layer 4 and the structure 3 each formed of the same component can be strongly bonded to each other, thereby further stabilizing the operation of the electron-emitting device. The oxide layer 4 can be electroconductive so as not to increase the operating voltage or so as to transfer electrons from the structure 3 to the lanthanum boride layer 5.

When the structure 3 is formed of molybdenum, the oxide layer 4 can be formed of an oxide of molybdenum. Because molybdenum dioxide ($MoO_2$) is an electroconductive oxide having a significantly lower resistivity (specific resistance) than molybdenum trioxide ($MoO_3$), the oxide layer 4 can be formed of molybdenum dioxide.

When the structure 3 is formed of tungsten, the oxide layer 4 can be formed of an oxide of tungsten. Because tungsten dioxide ($WO_2$) is an electroconductive oxide having a significantly lower resistivity than tungsten trioxide ($WO_3$), the oxide layer 4 can be formed of tungsten dioxide.

The thickness of the oxide layer 4 depends on its resistivity and practically ranges from 3 to 20 nm. The oxide layer 4 having a thickness below 3 nm cannot practically function as a diffusion barrier layer. The oxide layer 4 having a thickness above 20 nm may act as a resistance layer, increasing the operating voltage or preventing electron transfer from the structure 3 to the lanthanum boride layer 5.

The oxide layer 4 may be formed by any method, including a general film-forming method, such as sputtering, a method of heating the structure 3 at a high temperature in a controlled oxygen atmosphere, and a method utilizing extreme ultraviolet (EUV) irradiation. For example, the oxide layer 4 formed of $MoO_2$ can be prepared by sputtering Mo and irradiating the resulting Mo layer with EUV (for example, excimer UV).

While the oxide layer 4 can be electroconductive, the oxide layer 4 may be formed of or contain an insulating oxide. The oxide layer 4 can therefore contain La. The symbol "La" refers to a lanthanum element. Even when the oxide layer 4 is to be formed of an insulating oxide, the addition of La to the insulating oxide can decrease its resistivity, thus providing an electroconductive oxide layer 4.

La can combine with oxygen of an oxide in the oxide layer 4 to form a more stable lanthanum oxide. An oxide of lanthanum, dilanthanum trioxide ($La_2O_3$), has a relatively low resistivity among general metal oxides and is stable. Thus, the oxide layer 4 can stably transfer electrons from the structure 3 to the lanthanum boride layer 5, achieving stable electron emission characteristics.

The addition of La to an oxide free of La may alter the composition of the oxide, thereby increasing the electrical conductivity of the oxide.

When the structure 3 is formed of molybdenum, oxides of molybdenum may include insulating $MoO_3$. Because a molybdenum oxide layer 4 containing La contains $La_2O_3$ and $MoO_2$, the molybdenum oxide layer 4 containing La will have a higher electrical conductivity than an oxide layer formed of $MoO_3$.

When the structure 3 is formed of tungsten, oxides of tungsten may include insulating $WO_3$. Because a tungsten oxide layer 4 containing La contains $La_2O_3$ and $WO_2$, the tungsten oxide layer 4 containing La will have a higher electrical conductivity than an oxide layer formed of $WO_3$.

The La content of the oxide layer 4 may be appropriately determined in consideration of electron emission characteristics and practically ranges from 5% to 30% in terms of atomic concentration. The main component of the oxide layer 4 is not La but an oxide base material. Consequently, for example, the total atomic concentration of molybdenum and oxygen or tungsten and oxygen ranges from 70% to 95%.

An oxide layer 4 containing La may be prepared by doping an oxide layer free of La with La or sputtering a target that contains an oxide-forming material and La.

The lanthanum boride layer 5 used in the present embodiment functions as a low-work-function layer and is electroconductive. A boride of lanthanum of the lanthanum boride layer 5 can be lanthanum hexaboride ($LaB_6$). Lanthanum hexaboride has a stoichiometric La:B ratio of 1:6 and has a simple cubic lattice. The lanthanum boride layer 5 may contain a boride of lanthanum having a nonstoichiometric composition and/or a boride of lanthanum having a different lattice constant.

The lanthanum boride layer 5 can be a polycrystalline lanthanum boride layer rather than a monocrystalline lanthanum boride layer. A polycrystalline lanthanum boride layer exhibits conductivity similar to the conductivity of metal and is electroconductive. A polycrystalline layer can be more easily formed than a monocrystalline layer. A polycrystalline layer can be formed on a structure 3 having complex fine surface roughness and decrease the internal stress of the structure 3. Although a polycrystalline layer has a higher work function than a monocrystalline layer, the thickness or crystallite size of a polycrystalline layer can be controlled to achieve a work function below 3.0 eV, which is close to the work function of a monocrystalline layer.

As illustrated in FIG. 2, the lanthanum boride layer 5 can be overlaid with a lanthanum oxide layer 6. The lanthanum oxide layer 6 is formed of an oxide of lanthanum ($LaO_X$). Oxides of lanthanum are more stable than borides of lanthanum in an atmosphere. The lanthanum oxide layer 6 is typically formed of dilanthanum trioxide ($La_2O_3$). A $La_2O_3$ layer, which is a typical lanthanum oxide layer 6, is more stable in an atmosphere, particularly an atmosphere containing oxygen, than a $LaB_6$ layer, which is a typical lanthanum boride layer 5. $La_2O_3$ has a low work function of approximately 2.6 eV, which is close to the work function of $LaB_6$ (approximately 2.5 eV). The lanthanum oxide layer 6 disposed on the lanthanum boride layer 5 therefore contributes to further stable electron emission characteristics. Lanthanum boride can stably combine with lanthanum oxide.

From a practical standpoint, the lanthanum oxide layer 6 can have a thickness in the range of 1 to 10 nm. A lanthanum oxide layer having a thickness below 1 nm has little effect. A lanthanum oxide layer having a thickness above 10 nm reduces the electron emission level.

The lanthanum oxide layer 6 may be formed on the lanthanum boride layer 5 by any method. For example, the lanthanum boride layer 5 may be heated in a controlled oxygen atmosphere to form a lanthanum oxide layer on the surface. Alternatively, the lanthanum oxide layer 6 may be formed by a general film-forming technique, such as vapor deposition or sputtering.

In the electron-emitting device illustrated in FIG. 2, electrons are emitted from one or both of the lanthanum boride layer 5 and the lanthanum oxide layer 6. In FIG. 2, the structure 3, the oxide layer 4, the lanthanum boride layer 5, and the lanthanum oxide layer 6 constitute an electron-emitting member 9. Although the lanthanum oxide layer 6 entirely covers the lanthanum boride layer 5 in FIG. 2, the lanthanum oxide layer 6 may partly covers the lanthanum boride layer 5. In this case, an uncovered portion of the lanthanum boride layer 5 and the lanthanum oxide layer 6 constitute the surface of the electron-emitting member 9.

The electron-emitting devices according to the embodiments of the present invention will be further described below.

Although the cathode electrode 2 is disposed between the structure 3 and the substrate 1 in FIGS. 1 and 2, the cathode electrode 2 may be disposed at any position provided that the cathode electrode 2 can supply electrons to the structure 3. For example, the cathode electrode 2 may be juxtaposed to the structure 3. The cathode electrode 2 may be formed of any electroconductive material. Examples of the electroconductive material include metallic materials, such as Be, Mg, Ti, Zr, Hf, V, Nb, Ta, Mo, W, Al, Cu, Ni, Cr, Au, Pt, and Pd; alloys, carbides, borides, and nitrides thereof; and semiconductors, such as Si and Ge.

As described above, the structure 3 may be formed of any electroconductive member having such a geometry that the electric field strength on the surface of the lanthanum boride layer 5 or the lanthanum oxide layer 6 can be increased. More specifically, the structure 3 may have the shape of a quadrangular pyramid, a triangular pyramid, a rod, such as carbon fiber, a needle, or a ridge (plate). In other words, the structure 3 may typically be any electroconductive member having a projection or a raised portion in a direction away from the substrate 1. At least the tip of the projection or the raised portion of the electroconductive member is covered with the lanthanum boride layer 5 via the oxide layer 4. Although the oxide layer 4 entirely covers the structure 3 and is entirely covered with the lanthanum boride layer 5 in FIG. 1, the oxide layer 4 may partly cover the structure 3 and may be partly covered with the lanthanum boride layer 5. Also in FIG. 2, the lanthanum oxide layer 6 may partly cover the lanthanum boride layer 5.

The structure 3 has such electrical conductivity that electrons can be transferred from the cathode electrode 2 to the lanthanum boride layer 5 or to both the lanthanum boride layer 5 and the lanthanum oxide layer 6. The structure 3 may be formed of any electroconductive material, such as metal or semiconductor. The structure 3 will therefore contain metal or semiconductor. The structure 3 can be formed of metal because the metal can have a high melting point, can supply electrons stably to the lanthanum boride layer 5, and can be electroconductive as an oxide thereof. In particular, the metal can be molybdenum or tungsten. A resistor may be disposed between the cathode electrode 2 and the structure 3 or as part of the cathode electrode 2 to limit the emission current of the electron-emitting device 10. Alternatively, the cathode electrode 2 itself may function as a resistor.

In FIGS. 1 and 2, although the cathode electrode 2 and the structure 3 are formed of different materials for the sake of clarity, the cathode electrode 2 and the structure 3 may be integrated using a single material. Also in such a case, the cathode electrode 2 and the structure 3 can be formed of a high melting point metal, such as molybdenum or tungsten.

Figure 4:
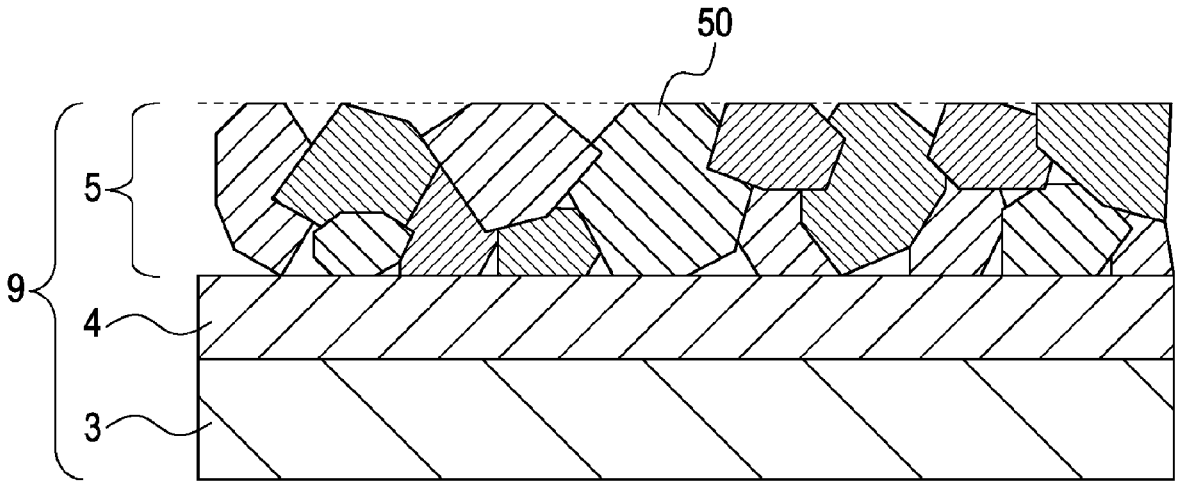
FIG. 4 is a schematic cross-sectional view of a polycrystalline lanthanum boride layer.

As illustrated in FIG. 4, the polycrystalline lanthanum boride layer 5 according to the present embodiment has the characteristics of a polycrystal composed of a large number of crystallites 50. The crystallites 50 are formed of lanthanum boride. A crystallite is the largest cluster identified as a single crystal. The polycrystalline layer 5 according to the present embodiment is a metallic layer in which crystallites 50 or clusters each composed of a plurality of crystallites 50 are in contact with one another, thereby exhibiting electrical conductivity. Voids and/or amorphous portions sometimes exist among the crystallites 50 or the clusters. FIG. 4 is a schematic cross-sectional view illustrating that the lanthanum boride layer 5 is a polycrystalline layer, without limitation to the materials for the oxide layer 4 and the structure 3.

The polycrystalline layer according to the present embodiment is therefore different from a fine-grain layer composed of fine grains (for example, amorphous fine grains). The term "grain" is often used inconsistently and includes a grain composed of a plurality of crystallites, an amorphous particle, and a grain having a particle appearance.

In one embodiment, the crystallites 50 of the polycrystalline lanthanum boride layer 5 according to the present embodiment have a size of 2.5 nm or more. The polycrystalline layer 5 has a thickness of 100 nm or less. Thus, the crystallites 50 of the polycrystalline layer 5 are to have a size of 100 nm or less. Likewise, the polycrystalline layer 5 is to have a thickness of 2.5 nm or more. A polycrystalline layer having a crystallite size of 2.5 nm or more has a more stable (smaller fluctuations in) emission current than a polycrystalline layer having a crystallite size below 2.5 nm. A crystallite size above 100 nm results in a polycrystalline layer having a thickness above 100 nm, which often becomes detached from the underlying layer, resulting in unstable characteristics of an electron-emitting device. At a crystallite size below 2.5 nm, the work function is greater than 3.0 eV. It seems that the ratio of B to La greatly deviates from 6.0 and that the polycrystalline layer has such an unstable state that the crystallinity cannot be maintained. A polycrystalline layer having a thickness of 20 nm or less exhibits small fluctuations in electron emission characteristics.

The crystallite size can typically be measured by an X-ray diffraction analysis and can be determined from the diffraction profile by a Scherrer method. The X-ray diffraction analysis can be used not only to measure the crystallite size, but also to examine crystalline orientation and whether or not the polycrystalline layer 5 is formed of a stoichiometric lanthanum hexaboride polycrystal. Cross-sectional TEM observation of the polycrystalline layer 5 shows substantially parallel lattice fringes in a region corresponding to a crystallite. After two lattice fringes that have the greatest distance therebetween are selected, the length of the longest line segment between an end of one lattice fringe and an end of the other lattice fringe is considered as the crystallite size (crystallite diameter). When a plurality of crystallites are identified in an area observed by cross-sectional TEM, the mean value of their crystallite sizes is considered as the crystallite size of the polycrystalline lanthanum boride layer.

The work function of a lanthanum boride layer can be determined by photoelectron spectroscopy, such as vacuum ultraviolet photoelectron spectroscopy (UPS), a Kelvin method, a method of measuring a field-emission current in a vacuum to determine the work function from the relationship between the electric field and the electric current, or a combination thereof.

More specifically, a film (for example, a molybdenum film) having a thickness of approximately 20 nm and a known work function is formed on a sharp tip (projection) of an electroconductive needle (for example, a tungsten needle). An electric field is then applied to the film in a vacuum to evaluate electron emission characteristics. A field enhancement factor for the shape of the projection of the electroconductive needle is determined from the electron emission characteristics. A lanthanum boride film is then formed on the projection to determine the work function of the lanthanum boride film.

Figure 5A:
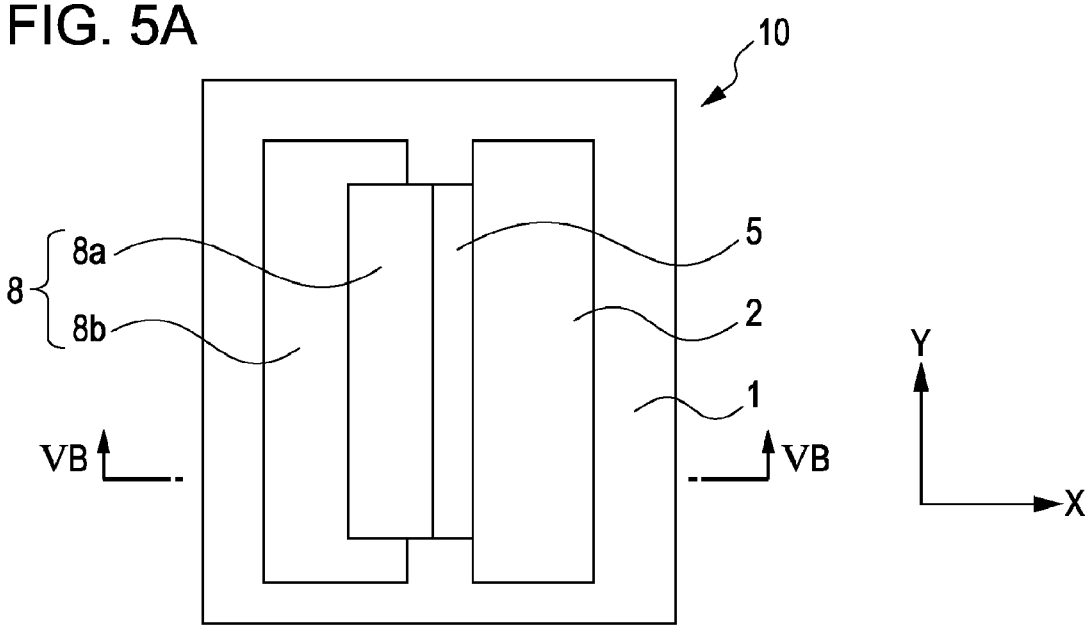
FIGS. 5A to 5C are schematic cross-sectional views of an electron-emitting device according to another embodiment of the present invention.
Figure 5B:
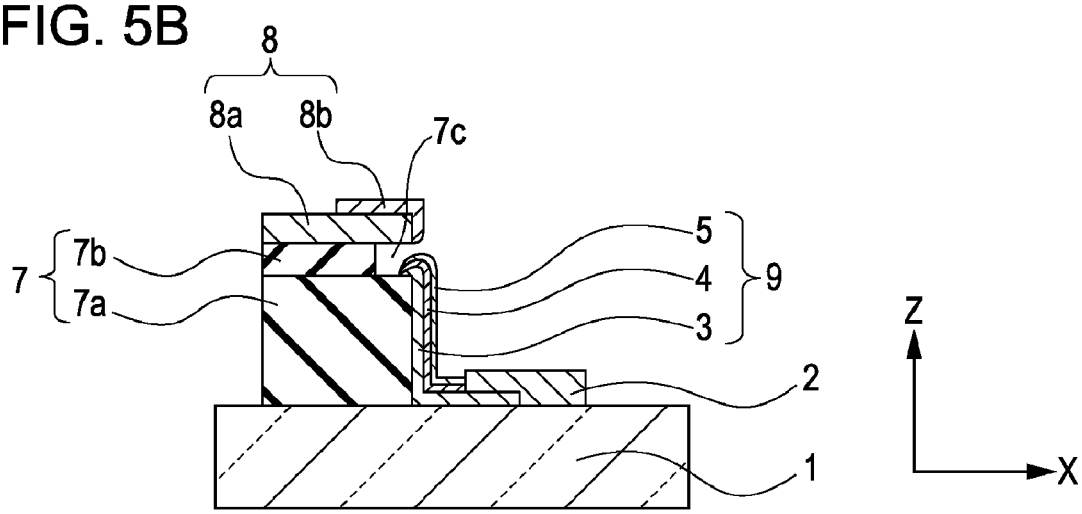
Figure 5C:
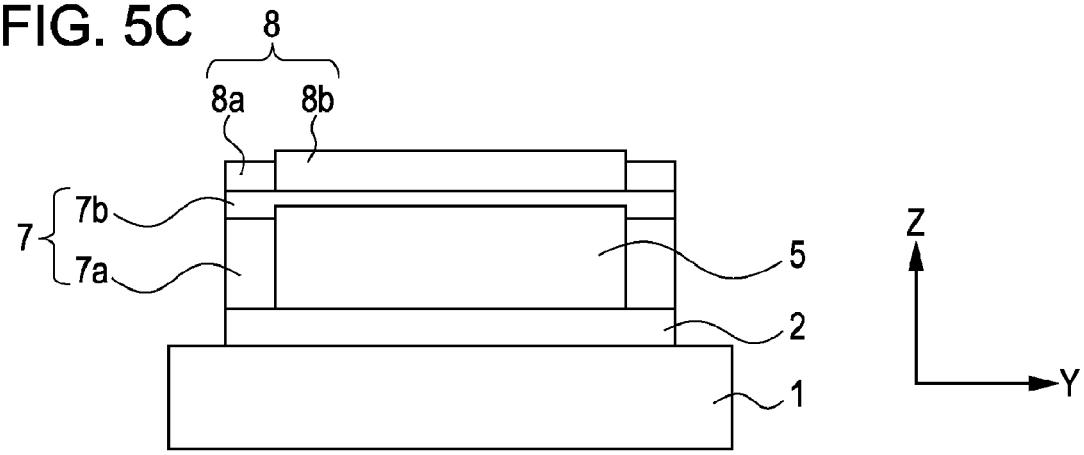

A field-emission-type electron-emitting device different from the electron-emitting devices including the conical structures illustrated in FIGS. 1 and 2 will be described below with reference to FIGS. 5A to 5C. FIG. 5A is a schematic plan view of an electron-emitting device viewed in the Z direction. FIG. 5B is a schematic cross-sectional view (Z-X plane) taken along the line VB-VB in FIG. 5A. FIG. 5C is a schematic view of the electron-emitting device viewed in the X direction.

An electron-emitting device 10 includes a gate electrode 8 on an insulating layer 7, which is disposed on top of a substrate 1. The insulating layer 7 includes a first insulating sublayer 7*a* and a second insulating sublayer 7*b*. The substrate 1 is overlaid with a cathode electrode 2. The cathode electrode 2 is connected to a structure 3 formed of an electroconductive member. The structure 3 extends from the substrate 1 to a side surface of the insulating layer 7 (a side surface of the first insulating sublayer 7*a* in FIG. 5). The structure 3 is overlaid with an oxide layer 4, and the oxide layer 4 is overlaid with a lanthanum boride layer 5. In other words, the oxide layer 4 is disposed between the structure 3 and the lanthanum boride layer 5. The structure 3, the oxide layer 4, and the lanthanum boride layer 5 constitute an electron-emitting member 9. As is clear from FIG. 5B, the structure 3 extends from the substrate 1 in the +Z direction and has a projection. The electron-emitting member 9 is geometrically similar to the structure 3 and also has a projection. Thus, the electron-emitting member 9 has a projection having such a geometry that the electric field strength on the surface of the electron-emitting member 9 can be increased. The gate electrode 8 is separated from the projection of the electron-emitting member 9.

Although the structure 3 is covered with the oxide layer 4 and the lanthanum boride layer 5, it may be sufficient to cover only the projection of the structure 3 with the oxide layer 4 and the lanthanum boride layer 5. As described with reference to FIG. 4, the lanthanum boride layer 5 can be a polycrystalline lanthanum boride layer. The oxide layer 4 can contain a lanthanum element. As described with reference to FIG. 2, the surface of the lanthanum boride layer 5 can be overlaid with a lanthanum oxide layer (not shown). Also in the electron-emitting device 10 illustrated in FIG. 5, the lanthanum oxide layer may partly or entirely cover the lanthanum boride layer 5. When the lanthanum oxide layer partly covers the lanthanum boride layer 5, an uncovered portion of the lanthanum boride layer 5 and the lanthanum oxide layer constitute the surface of the electron-emitting member 9.

In FIGS. 5A to 5C, the gate electrode 8 includes a first electroconductive sublayer 8*a* and a second electroconductive sublayer 8*b*. The first electroconductive sublayer 8*a* is partly covered with the second electroconductive sublayer 8*b*, which is formed of the electroconductive material of the structure 3. Although the second electroconductive sublayer 8*b* may be omitted, the second electroconductive sublayer 8*b* can be formed to generate a stable electric field. The gate electrode 8 (8*a* and 8*b*) may be overlaid with a lanthanum boride layer. Although the electron-emitting member 9 continuously extends in the Y direction as a ridge (plate) in FIGS. 5A and 5C, a plurality of electron-emitting members may be disposed at predetermined intervals in the Y direction.

Figure 6A:
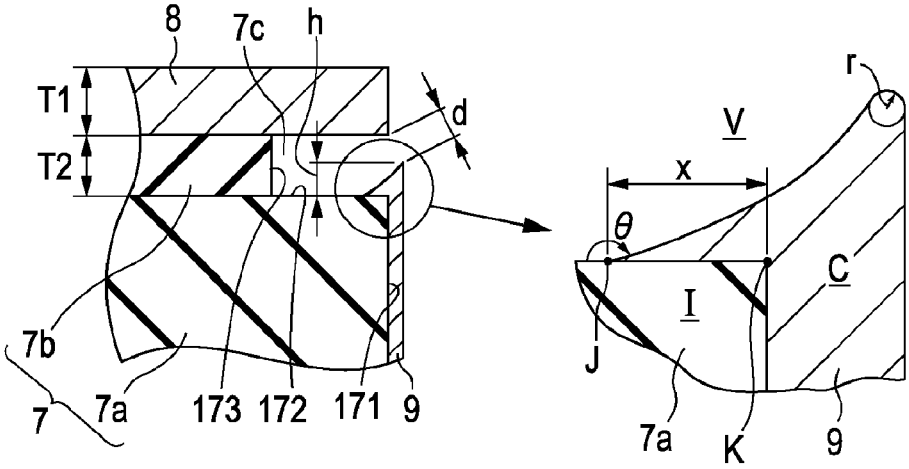
FIG. 6A illustrates a schematic fragmentary cross-sectional view of an electron-emitting device according to another embodiment of the present invention and its fragmentary enlarged view.

The electron-emitting device 10 will be further described below with reference to FIGS. 6A to 6C. FIG. 6A illustrates fragmentary enlarged cross-sectional views of the neighborhood of the projection of the structure 3. For the sake of brevity, the structure 3, the oxide layer 4, and the lanthanum boride layer 5 are not individually described but are described together as the electron-emitting member 9.

The second insulating sublayer 7*b* has a smaller width than the first insulating sublayer 7*a* in the X direction. A side surface 173 of the second insulating sublayer 7*b* is recessed relative to a side surface 171 of the first insulating sublayer 7*a*. The top surface 172 of the first insulating sublayer 7*a* is partly exposed. The top surface 172 of the first insulating sublayer 7*a* is in contact with the side surface 171 of the first insulating sublayer 7*a* via a corner K, which is an edge of the side surface 171 of the first insulating sublayer 7*a* closer to the gate electrode 8. Thus, the insulating layer 7 has a depression 7*c* defined by the top surface 172 of the first insulating sublayer 7*a* and the side surface 173 of the second insulating sublayer 7*b*. Typically, the top surface 172 of the first insulating sublayer 7*a* is substantially parallel to the surface of the substrate 1. Although the side surface 171 of the first insulating sublayer 7*a* is substantially perpendicular to the substrate 1 in FIG. 5B, the first insulating sublayer 7*a* may be formed such that the side surface 171 is inclined relative to the surface of the substrate 1. The side surface 171 can make an acute angle with the surface of the substrate 1. When the side surface 171 is inclined relative to the surface of the substrate 1, the corner K of the first insulating sublayer 7*a* may have an obtuse angle (an angle inside the first insulating sublayer 7*a*). The corner K practically has a certain curvature. Since the top surface 172 of the first insulating sublayer 7*a* and the side surface 173 of the second insulating sublayer 7*b* are disposed inside the depression 7*c*, the top surface 172 and the side surface 173 may be referred to as an inner surface of the insulating layer 7. Likewise, since the side surface 171 of the first insulating sublayer 7*a* is disposed outside the depression 7*c*, the side surface 171 may be referred to as an outer surface of the insulating layer 7.

In FIG. 6A, the projection of the electron-emitting member 9 has a height h (h>0) relative to the top surface 172 of the first insulating sublayer 7*a*. A portion at a height h corresponds to the tip of the projection. A portion (projection) of the electron-emitting member 9 extends from the side surface 171 to the top surface 172 of the first insulating sublayer 7*a* inside the depression 7*c*. As illustrated in FIG. 5B, at least a portion (projection) of the structure 3 is disposed inside the depression 7*c*. In other words, a portion (projection) of the electron-emitting member 9 is disposed inside the depression 7*c*. Thus, a portion of the projection of the electron-emitting member 9 is disposed inside the depression 7*c* and is in contact with the top surface 172 of the first insulating sublayer 7*a*. The portion of the electron-emitting member 9 includes at least a portion of the structure 3. An interface between the projection of the electron-emitting member 9 and the top surface 172 of the first insulating sublayer 7*a* has a length x (x>0) in the depth direction of the depression 7*c*. In other words, the length x is the distance between an end (point J) of the projection in contact with the surface of the insulating layer 7 inside the depression 7*c* and an edge of the depression 7*c*, that is, a bend (point K) of the first insulating sublayer 7*a*. The length x depends on the depth of the depression 7*c* and practically ranges from 10 to 100 nm.

The gate electrode 8 is adjacent to the depression 7*c* and is separated from the projection of the electron-emitting member 9. More specifically, the gate electrode 8 faces the top surface 172 of the first insulating sublayer 7*a* and is separated from the top surface 172 by a distance T2. The distance T2 corresponds to the thickness of the second insulating sublayer 7*b*. Thus, the second insulating sublayer 7*b* defines the distance between the top surface 172 of the first insulating sublayer 7*a* and the gate electrode 8.

As illustrated in FIG. 6A, the gate electrode 8 and the tip of the projection of the electron-emitting member 9 are separated by a distance d. The distance d is the shortest distance between the gate electrode 8 and the electron-emitting member 9. The tip of the projection has a curvature radius r. At a constant potential difference between the gate electrode 8 and the electron-emitting member 9, the electric field strength in the vicinity of the tip of the projection depends on the curvature radius r and the distance d. A smaller curvature radius r results in a higher electric field strength in the vicinity of the tip of the projection. A shorter distance d also results in a higher electric field strength in the vicinity of the tip of the projection.

At a constant electric field strength in the vicinity of the tip of the projection, the distance d is inversely proportional to the curvature radius r. The frequency (number) of electron scatterings by the gate electrode 8 depends on the distance d. The efficiency of an electron-emitting device increases with decreasing curvature radius r and increasing distance d. The efficiency ($\eta$) is given by the equation: $\eta$=Ie/(If+Ie), wherein If denotes an electric current measured when a voltage is applied to an electron-emitting device, and Ie denotes an electric current extracted in a vacuum.

The presence of a portion of the structure 3 inside the depression 7*c* has the following benefits. (1) The presence increases the contact area between the structure 3 and the first insulating sublayer 7*a*, thereby increasing the mechanical adhesiveness (adhesion strength) therebetween. This can prevent the detachment of the electron-emitting member 9 in a process for manufacturing an electron-emitting device. (2) The presence can increase the contact area between the structure 3 and the first insulating sublayer 7*a*, thereby efficiently dissipating heat generated by an electron-emitting portion. (3) The presence can decrease the electric field strength at a triple junction between an insulator, a vacuum, and an electric conductor in the depression 7*c*, thereby decreasing the incidence of discharge phenomenon caused by the generation of an abnormal electric field.

The benefit (2) is described in detail below.

Figure 6B:
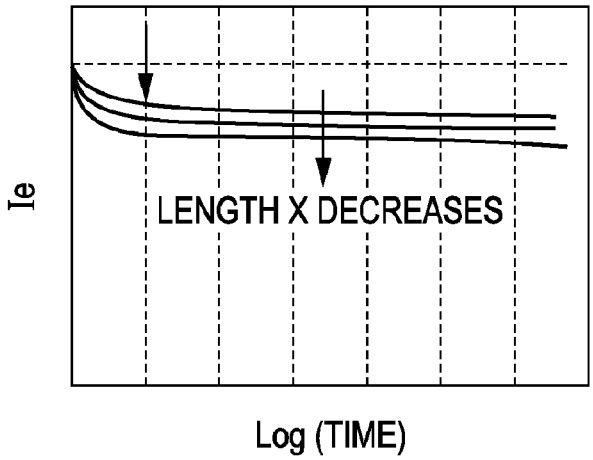
FIG. 6B is a graph illustrating changes in Ie for different lengths x in a depression 7*c*.

FIG. 6B illustrates changes in Ie for different lengths x in the depression 7*c*. The term "Ie", as used herein, refers to the electron emission level, that is, the number of electrons that reach an anode. As an initial value, a mean electron emission level Ie was measured for 10 seconds from the start of the operation of an electron-emitting device. Changes in electron emission level relative to the initial Ie were plotted as a function of the common logarithm of time. FIG. 6B shows that a reduction in electron emission level is decreased with an increase of length x. In FIG. 6B, the arrow in the left hand shows a reduction in electron emission level, and the arrow in center shows decreasing of length x.

Figure 6C:
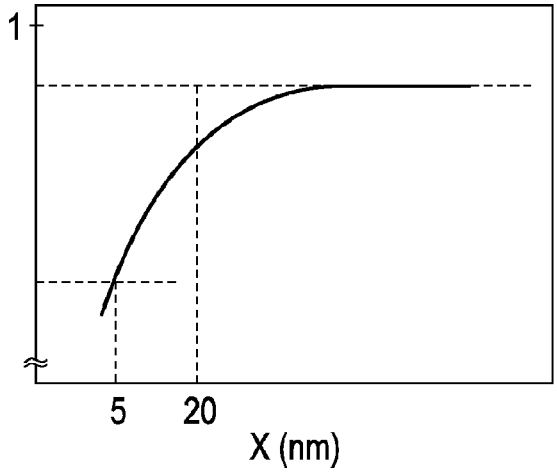
FIG. 6C is a graph illustrating the relative electron emission level as a function of length x.

The measurement shown in FIG. 6B was performed for several electron-emitting devices (FIG. 6C). FIG. 6C is a graph of the electron emission level relative to the initial Ie as a function of the length x at a predetermined time after the start of the operation of the electron-emitting devices. As is clear from FIG. 6C, a reduction in electron emission level is decreased with an increase of length x. At a length x above 20 nm, the relative electron emission level depends less on the length x. Thus, the length x can be 20 nm or more.

These results suggest that a longer length x results in a greater contact area between the projection and the first insulating sublayer 7*a*, thereby decreasing the thermal resistance therebetween. Furthermore, an increase in the volume of the projection of the electron-emitting member 9 results in an increase in the heat capacity of the projection. The low thermal resistance and the high heat capacity can decrease the temperature increase of the electron-emitting member 9, thereby decreasing the initial changes in electron emission level.

However, an excessively long length x results in an increase in leakage-current between the electron-emitting member 9 and the gate electrode 8 via the inner surface of the depression 7*c*, that is, the top surface 172 of the first insulating sublayer 7*a* and the side surface 173 of the second insulating sublayer 7*b*. Thus, the length x can be shorter than the depth of the depression 7*c*.

The benefit (3) will be described in detail below.

A junction of three materials having different dielectric constants, such as a vacuum, an insulator, and an electric conductor, is referred to as a triple junction. Depending on the conditions, a triple junction having an extremely stronger electric field than its surrounding environments may induce discharge. A point J in FIG. 6A is a triple junction of a vacuum (region V), an insulator (region I), and an electric conductor (region C). When the angle $\theta$ between the projection of the electron-emitting member 9 and the first insulating sublayer 7*a* is 90° or more, the triple junction J does not have an electric field significantly different from the electric field of its surrounding environments. When the projection of the electron-emitting member 9 has an angle $\theta$ of 90° or more, therefore, the electric field strength at the triple junction can be decreased, and a discharge phenomenon caused by the generation of an abnormal electric field can be prevented.

The angle $\theta$ between the surface of the electron-emitting member 9 (in particular, the surface in the vicinity of an end (point J) of the electron-emitting member 9) and the top surface 172 of the first insulating sublayer 7*a* can be greater than 90°. The angle $\theta$ can be smaller than 180°. It should be noted that the angle $\theta$ is an angle between the surface of the electron-emitting member 9 and the top surface 172 of the first insulating sublayer 7*a* on the vacuum side. When the top surface 172 is flat, the contact angle between the electron-emitting member 9 and the top surface 172 is expressed by 180°-$\theta$. Because the top surface 172 of the first insulating sublayer 7*a* is practically flat, the contact angle between the top surface 172 and the electron-emitting member 9 can be greater than 0° but smaller than 90°. The surface of the electron-emitting member 9 within the depression 7*c* can be gently inclined relative to the top surface 172 of the first insulating sublayer 7*a*. More specifically, the angle between a tangent line at any point on the surface of the electron-emitting member 9 within the depression 7*c* and the top surface 172 of the first insulating sublayer 7*a* can be smaller than 90°.

An exemplary method for manufacturing the electron-emitting device illustrated in FIG. 5 will be described below.

The substrate 1 may be formed of quartz glass, glass containing a lesser amount of impurities, such as Na, soda-lime glass, or silicon. A substrate can have resistance to dry etching, wet etching, and alkaline and acid, such as a developer, as well as high mechanical strength. In the case of an integrated substrate, such as a display panel, the difference in thermal expansion between the substrate and a film-forming material or another member to be layered can be small. A substrate can be formed of a material that can reduce the diffusion of alkali elements from the inside of the substrate in heat treatment.

First, the first insulating sublayer 7*a* and the second insulating sublayer 7*b* are sequentially formed to construct a step on the substrate 1. The gate electrode 8 (the first electroconductive sublayer 8*a*) is formed on the second insulating sublayer 7*b*.

The first insulating sublayer 7*a* is an insulating film formed of an easily processable material, such as silicon nitride or silicon oxide, and is formed by general vacuum deposition, such as chemical vapor deposition (CVD), vacuum evaporation, or sputtering. The first insulating sublayer 7*a* has a thickness in the range of several nanometers to several tens of micrometers and has a thickness in the range of several tens to several hundreds of nanometers.

The second insulating sublayer 7*b* is an insulating film formed of an easily processable material, such as silicon nitride or silicon oxide, and can be formed by general vacuum deposition, such as CVD, vacuum evaporation, or sputtering. The second insulating sublayer 7*b* has a thickness T2 in the range of several to several hundreds of nanometers and has a thickness in the range of several to several tens of nanometers.

While the details are described below, the first insulating sublayer 7*a* and the second insulating sublayer 7*b* can be formed of different materials to form the depression 7*c* precisely. For example, the first insulating sublayer 7*a* is formed of silicon nitride, and the second insulating sublayer 7*b* is formed of silicon oxide, phosphosilicate glass (PSG) having a high phosphorus content, or boron silicate glass (BSG) having a high boron content.

The first electroconductive sublayer 8*a* is electroconductive and can be formed by a general vacuum deposition technique, such as vapor deposition or sputtering. The gate electrode 8 has a thickness T1 in the range of several to several hundreds of nanometers and has a thickness in the range of several tens to several hundreds of nanometers.

The material for the first electroconductive sublayer 8*a* can have high thermal conductivity and a high melting point, as well as high electrical conductivity. Examples of the material include metals, such as Be, Mg, Ti, Zr, Hf, V, Nb, Ta, Mo, W, Al, Cu, Ni, Cr, Au, Pt, and Pd, and alloys thereof. Examples of the material further include nitrides, oxides, carbides, semiconductors, carbon, and carbon compounds.

The first insulating sublayer 7*a*, the second insulating sublayer 7*b*, and the first electroconductive sublayer 8*a* can be patterned by photolithography and etching. Etching may be reactive ion etching (RIE).

The second insulating sublayer 7*b* is then selectively etched to form the depression 7*c* in the insulating layer 7, which consists of the first insulating sublayer 7*a* and the second insulating sublayer 7*b*. The ratio of the etching rate of the second insulating sublayer 7*b* to the etching rate of the first insulating sublayer 7*a* can be 10 or more or 50 or more.

To perform selective etching, when the second insulating sublayer 7*b* is silicon oxide, buffered hydrofluoric acid (BHF), which is a mixed solution of ammonium fluoride and hydrofluoric acid, can be used. When the second insulating sublayer 7*b* is silicon nitride, a hot phosphoric acid etchant can be used.

The depth of the depression 7*c* (the width of a portion of the top surface 172 of the first insulating sublayer 7*a* exposed by selective etching) is closely related to the leakage-current of the electron-emitting device 10. A greater depth of the depression 7*c* results in a lower leakage-current. However, an excessively greater depth of the depression 7*c* may result in the deformation of the gate electrode 8. Thus, the depth of the depression 7*c* can range from approximately 30 to 200 nm.

Instead of the selective etching of different materials, while part of the side surface of the insulating layer 7 is masked, an unmasked portion of the insulating layer 7 can be removed to form the depression 7*c*. In this case, the first insulating sublayer 7*a* and the second insulating sublayer 7*b* may be formed as a single layer of a single material. Alternatively, the insulating layer 7 may be composed of three sublayers, and the second sublayer may be selectively etched. In this case, the surface of the gate electrode 8 adjacent to the depression 7*c* is covered with the third sublayer.

The material for the structure 3 is then applied to the top surface 172 and the side surface 171 of the first insulating sublayer 7*a*. The material for the structure 3 can have high thermal conductivity and a high melting point, as well as high electrical conductivity. The material for the structure 3 can have a work function of 5 eV or less. Examples of the material include metals, such as Be, Mg, Ti, Zr, Hf, V, Nb, Ta, Mo, W, Al, Cu, Ni, Cr, Au, Pt, and Pd, and alloys thereof. Examples of the material further include nitrides, oxides, carbides, semiconductors, carbon, and carbon compounds. Among others, the material for the structure 3 can be Mo and W.

The structure 3 can be formed by a general vacuum deposition technique, such as vapor deposition or sputtering. As described above, in the present embodiment, the incident angle of the material for the structure 3, the film-forming time, the film-forming temperature, and the degree of vacuum should be adjusted to control the shape of the projection of the electron-emitting member 9. The incident angle of the electroconductive material can be determined in consideration of the thickness T1 of the gate electrode 8 and the distance T2 between the first insulating sublayer 7*a* and the gate electrode 8.

In the same manner as the conical electron-emitting member 9, the oxide layer 4 and the lanthanum boride layer 5 are formed on the structure 3. The lanthanum boride layer 5 can be overlaid with a lanthanum oxide layer 6.

The cathode electrode 2 can be formed by a general vacuum deposition technique, such as vapor deposition or sputtering. Alternatively, the cathode electrode 2 can be formed by firing a precursor containing an electroconductive material. Patterning can be performed using photolithography or a printing technique.

The material for the cathode electrode 2 may be any electroconductive material and may be the material of the gate electrode 8. The cathode electrode 2 has a thickness in the range of several tens of nanometers to several micrometers and has a thickness in the range of several tens to several hundreds of nanometers. The cathode electrode 2 may be formed before or after the formation of the structure 3. The cathode electrode 2 may be formed after the formation of the electron-emitting member 9.

As described above, in the electron-emitting device according to the present embodiment, a voltage is applied between the first electrode (cathode electrode) and the second electrode (gate electrode) disposed apart from the first electrode to emit electrons in an electric field from the first electrode. To irradiate a member (e.g. an anode electrode) other than the gate electrode with electrons emitted from the electron-emitting device, an irradiated member (the anode electrode) is disposed apart from the substrate 1 illustrated in FIGS. 1, 2, and 5. The projection of the electron-emitting member 9 and its tip are directed to the anode. The distance between the anode and the substrate 1 is much greater than the distance between the cathode electrode 2 and the gate electrode 8 and typically ranges from 500 μm to 2 mm. The electric potential applied to the anode is much higher than the electric potential applied to the gate electrode 8. This allows electrons drawn by the gate electrode 8 (electrons emitted in an electric field) to reach the anode. Such an electron-emitting apparatus (electron beam apparatus) has a three-terminal (cathode electrode, gate electrode, and anode electrode) structure. An electron-emitting apparatus having a two-terminal structure (cathode electrode and anode electrode) by omitting the gate electrode or by utilizing the gate electrode as an anode electrode, may be used.

Fluctuations in emission current from an electron-emitting device reflect temporal changes in emission current. For example, the emission current is observed by periodically applying a rectangular pulse voltage. Fluctuations in emission current can be calculated by dividing the deviation of changes in emission current per unit time by the mean emission current.

More specifically, a rectangular pulse voltage having a pulse width of 6 ms and a period of 24 ms is continuously applied. A sequence of measuring the mean emission current in response to 32 successive rectangular pulse voltages is performed at intervals of 2 seconds, and the deviation and the mean emission current are obtained per 30 minutes. To compare fluctuations in electron emission among a plurality of electron-emitting devices, the peak value of an applied voltage is adjusted to produce a substantially constant mean electric current.

Figure 7:
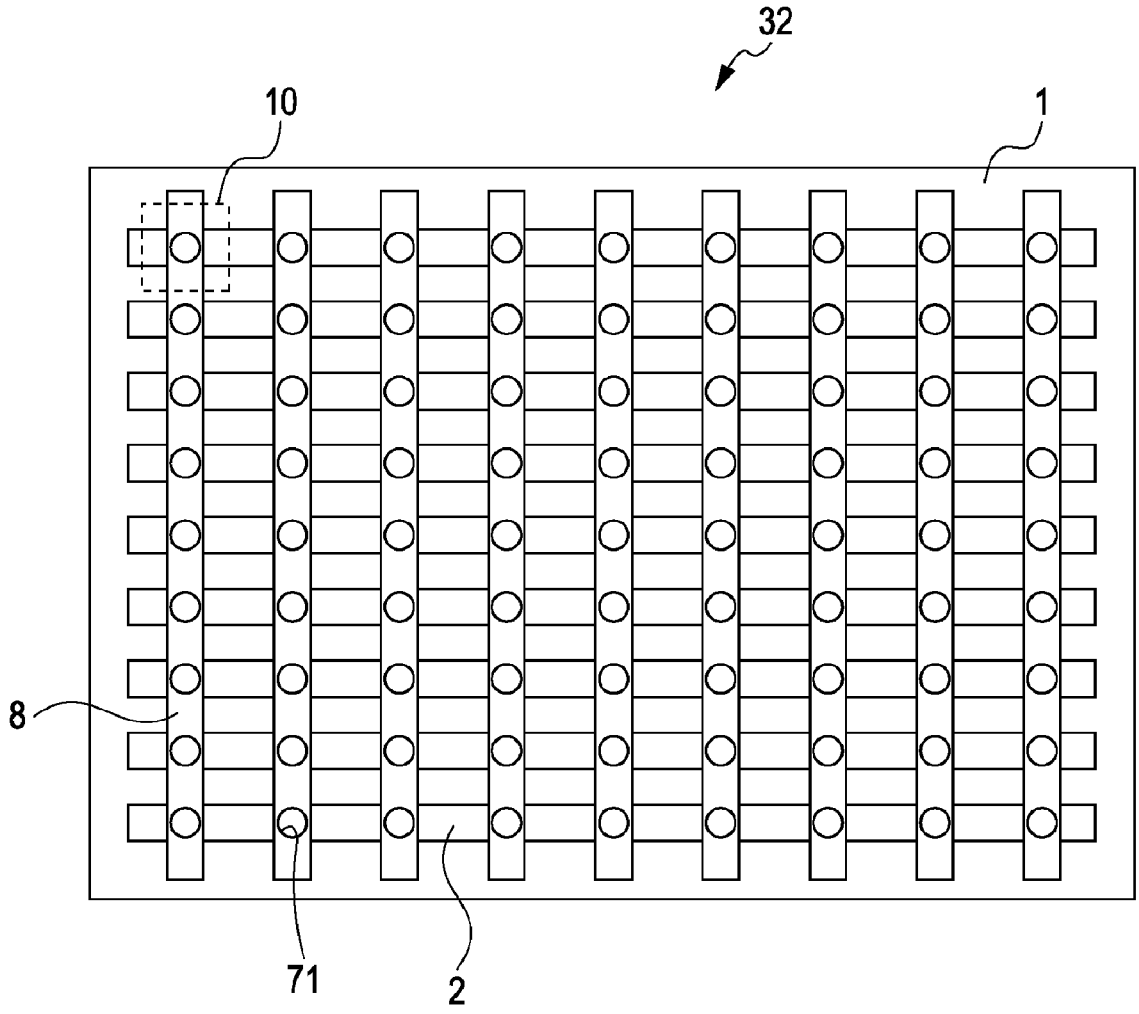
FIG. 7 is a schematic plan view of an electron source.

An electron source 32 that includes a large number of electron-emitting devices 10 on a substrate 1 will be described below with reference to FIG. 7. The electron-emitting devices 10 include the conical electron-emitting member 9 described above. FIG. 7 is a schematic plan view of the electron source 32.

The electron source 32 includes the substrate 1 and a plurality of electron-emitting devices 10 arranged on the substrate 1. The substrate 1 may be an insulating substrate, such as a glass substrate. A matrix of electron-emitting devices 10 illustrated in FIG. 1 is disposed on the substrate 1. The electron-emitting device 10 may be the electron-emitting device 10 illustrated in FIG. 2 or 5.

Each column of electron-emitting devices 10 is connected to a gate electrode 8, and each row of electron-emitting devices 10 is connected to a cathode electrode 2. After predetermined numbers of cathodes 2 and gate electrodes 8 are selected, a voltage is applied to these electrodes, allowing predetermined electron-emitting devices 10 to emit electrons.

Although a single electron-emitting device 10 is disposed at an intersecting portion between the cathode electrode 2 and the gate electrode 8 in FIG. 7, a plurality of electron-emitting devices 10 can be disposed at the intersecting portion. For example, in the case of the electron-emitting device illustrated in FIG. 1 or 2, a plurality of openings 71 are provided at an intersecting portion between the cathode electrode 2 and the gate electrode 8, and the electron-emitting member 9 is disposed in each of the openings 71.

For the sake of brevity, a single opening 71 is disposed at an intersecting portion between the cathode electrode 2 and the gate electrode 8 in FIG. 7. However, the number of electron-emitting devices at an intersecting portion can be increased to decrease fluctuations in emission current. This is because a large number of electron-emitting devices can level off fluctuations in emission current. However, an excessively large number of electron-emitting devices at an intersecting portion may decrease productivity. Use of an electron-emitting device according to the present invention can decrease fluctuations in emission current. Fluctuations in emission current can therefore be decreased without increasing the number of electron-emitting devices.

An display panel 100 that includes the electron source 32 described above will be described below with reference to FIG. 8. The display panel 100 includes a plurality of electron-emitting devices at each intersecting portion.

The display panel 100 is hermetically sealed to have an internal pressure lower than atmospheric pressure (i.e., vacuum) and is also referred to as an airtight container.

Figure 8:
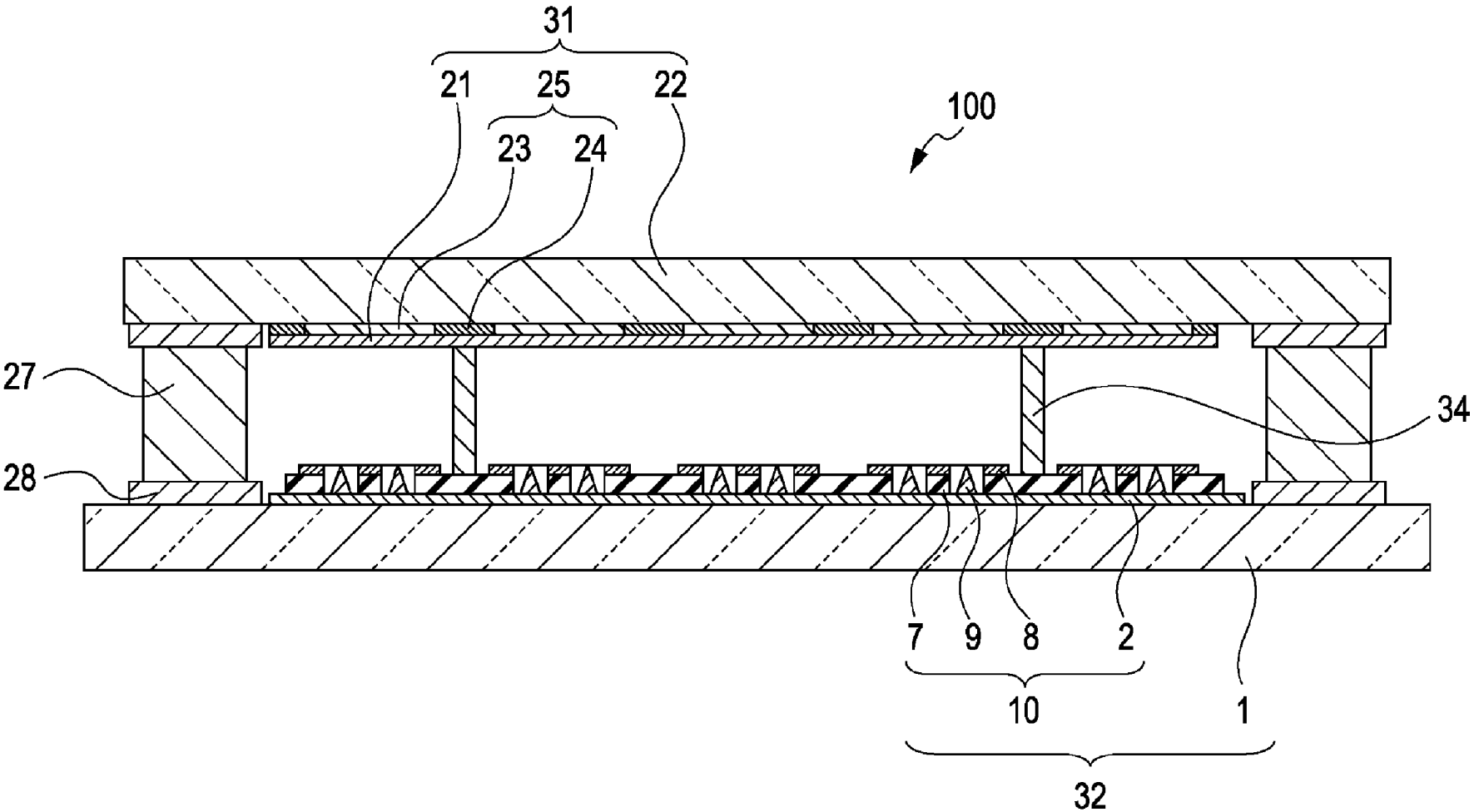
FIG. 8 is a schematic cross-sectional view of a display panel according to an embodiment of the present invention.

FIG. 8 is a schematic cross-sectional view of the display panel 100. The display panel 100 includes, as a rear plate 32, the electron source 32 illustrated in FIG. 7. The rear plate 32 faces a face plate 31.

A closed-circular (or rectangular) frame 27 is disposed between the rear plate 32 and the face plate 31 to maintain a predetermined distance therebetween. The distance between the rear plate 32 and the face plate 31 typically ranges from 500 μm to 2 mm (in practice, approximately 1 mm). The frame 27 and the face plate 31, and the frame 27 and the rear plate 32 are hermetically joined with a sealing joint 28, such as an indium or frit glass joint. The frame 27 also serves to hermetically seal the interior space of the display panel 100. For a large display panel 100, a plurality of spacers 34 can be placed between the face plate 31 and the rear plate 32 to maintain a predetermined distance therebetween.

The face plate 31 includes a light-emitting layer 25, an anode 21 disposed on the light-emitting layer 25, and a transparent substrate 22. The light-emitting layer 25 includes light-emitting members 23, which emit light in response to irradiation with electrons from an electron-emitting device 10.

The transparent substrate 22 is to be transparent to light from the light-emitting layer 25 and is therefore formed of glass, for example.

The light-emitting member 23 is generally a fluorescent member. When the light-emitting layer 25 includes light-emitting members that emit red, green, and blue light, the display panel 100 can display images in full color. The light-emitting layer 25 includes black members 24 between light-emitting members. The black members 24 are generally referred to as a black matrix and improve the contrast of displayed images.

Electron-emitting devices 10 face the light-emitting members 23 and irradiate the light-emitting members 23 with electrons. Each of the electron-emitting devices 10 faces the corresponding light-emitting member 23.

The anode 21 is generally referred to as a metal back and is typically formed of an aluminum film. The anode 21 may be disposed between the light-emitting layer 25 and the transparent substrate 22. In this case, the anode 21 is formed of a transparent electroconductive film, such as an indium tin oxide (ITO) film.

A process of hermetically joining the face plate 31 and the rear plate 32 (joining or sealing process) is performed while components of the airtight container, the display panel 100, are heated.

In the joining process (sealing process), the frame 27, together with the joints 28, such as frit glass joints, is typically disposed between the face plate 31 and the rear plate 32. The face plate 31, the rear plate 32, and the frame 27 are joined by heating them at a temperature, for example, in the range of 100° C. to 400° C. under pressure and then cooling them to room temperature. Before the joining process, the rear plate 32 is often heated to remove gases.

Even in such a process involving heating and cooling, the polycrystalline lanthanum boride layer 5 according to the present embodiment does not become detached from the electron-emitting member 9.

Figure 9:
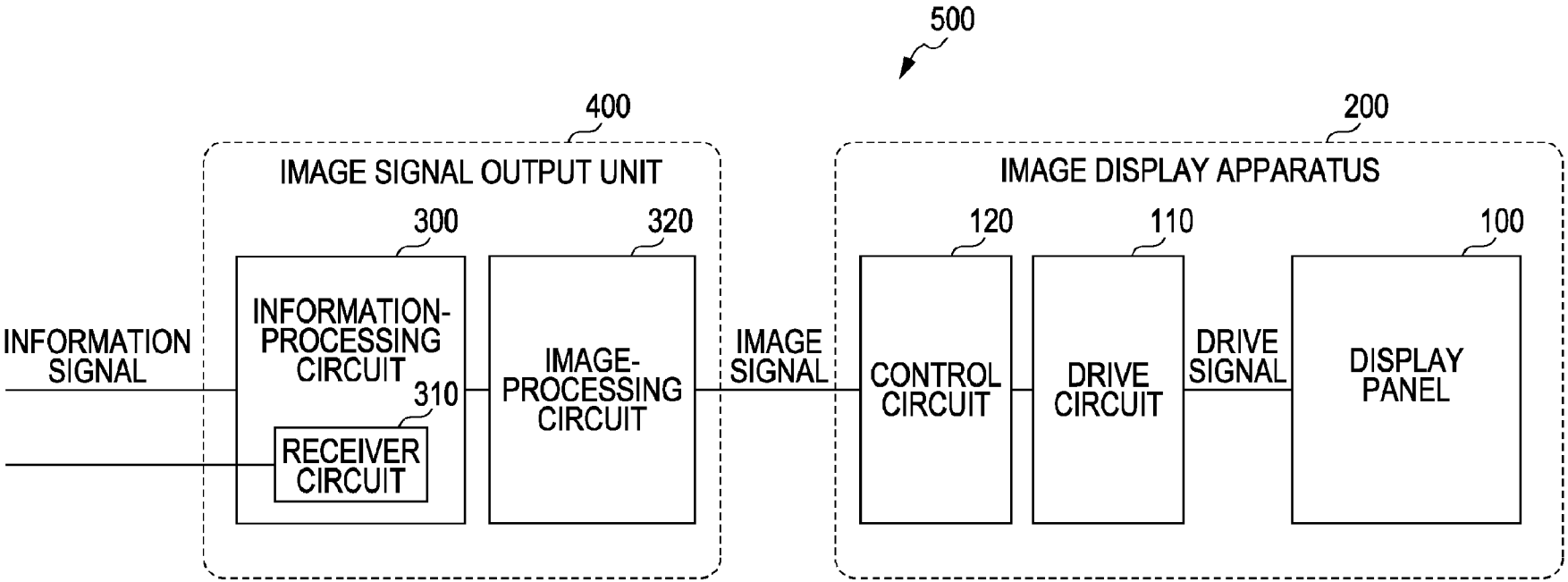
FIG. 9 is a block diagram of an information display system according to an embodiment of the present invention.

As illustrated in FIG. 9, the display panel 100 is connected to a drive circuit 110 for driving the display panel 100, thereby fabricating an image display apparatus 200. The image display apparatus 200 can be connected to an image signal output unit 400 to constitute an information display system 500. The image signal output unit 400 outputs an image signal based on an information signal, such as a television broadcast signal or a signal recoded in an information recording apparatus. In other words, the image display apparatus 200 can be provided with the image signal output unit 400.

The image display apparatus 200 includes the display panel 100 and the drive circuit 110 and can further include a control circuit 120. The control circuit 120 performs signal processing, such as correction, of an input image signal, suitable for the display panel 100 and outputs the image signal and various control signals to the drive circuit 110. On the basis of the image signal, the drive circuit 110 outputs a drive signal to lines of the display panel 100 (see the cathode electrode 2 and the gate electrode 8 in FIG. 8). The drive circuit 110 includes a modulation circuit for converting the image signal into the drive signal and a scanning circuit for selecting a line. On the basis of the drive signal from the drive circuit 110, the display panel 100 controls a voltage applied to each electron-emitting device corresponding to a pixel. The pixels emit light at a luminance according to the image signal, thereby displaying an image on a screen. The "screen" corresponds to the light-emitting layer 25 of the display panel 100 illustrated in FIG. 8.

FIG. 9 is a block diagram of an information display system 500. The information display system 500 includes the image signal output unit 400 and the image display apparatus 200. The image signal output unit 400 includes an information-processing circuit 300 and can further include an image-processing circuit 320. The image signal output unit 400 and the image display apparatus 200 may be placed in different housings, or the image display apparatus 200 and at least part of the image signal output unit 400 may be placed in a single housing. The information display system 500 is only an example, and various modifications may be made thereto.

The information-processing circuit 300 receives an information signal. Examples of the information signal include television broadcast signals, for example, of satellite broadcasting and terrestrial broadcasting, and data broadcast signals via telecommunication lines, such as a wireless network, a telephone network, a digital network, an analog network, and the Internet using a TCP/IP protocol. The information-processing circuit 300 may be connected to a storage, such as a semiconductor memory, an optical disk, or a magnetic storage, allowing information signals stored in these devices to be displayed on the display panel 100. The information-processing circuit 300 may also be connected to an image input device, such as a video camera, a still camera, or a scanner, allowing images stored in these devices to be displayed on the display panel 100. The information-processing circuit 300 may also be connected to a video conferencing system or a computer.

The information-processing circuit 300 can also process an image to be displayed on the display panel 100 and output the image to a printer or a storage.

Information contained in an information signal is at least one selected from the group consisting of image information, textual information, and audio information. The information-processing circuit 300 may include a receiver circuit 310, which may include a tuner for selecting information from a broadcast signal and a decoder for decoding an encoded information signal.

The information-processing circuit 300 outputs an image signal to the image-processing circuit 320. The image-processing circuit 320 may include a circuit for processing the image signal, such as a gamma-correction circuit, a resolution conversion circuit, and an interface circuit. The image-processing circuit 320 converts the image signal into an image signal in the signal format of the image display apparatus 200 and outputs the converted image signal to the image display apparatus 200.

Image or textual information can be output to the display panel 100 to be displayed on the screen in the following way. First, image and/or textual information of an information signal input to the information-processing circuit 300 is converted into an image signal for each pixel of the display panel 100. The image signal is input to the control circuit 120 of the image display apparatus 200. On the basis of an input image signal, the drive circuit 110 controls a voltage to be applied to each electron-emitting device of the display panel 100, thereby displaying an image. An audio signal is output to an audio-reproducing unit (not shown), such as a loudspeaker, to be reproduced in synchronism with image and/or textual information displayed on the display panel 100.

According to the present invention, a stable emission current from an electron-emitting device can improve the image quality of an image display apparatus.

EXAMPLES

More specific examples based on these embodiments will be described below.

Example 1

An electron-emitting device according to the present example and a method for manufacturing the electron-emitting device will be described below with reference to FIGS. 3A to 3H. The electron-emitting device included a conical structure 3.

Figure 3A:
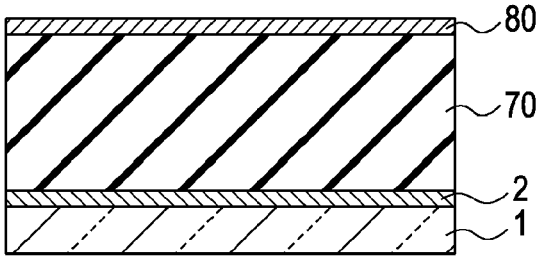
FIGS. 3A to 3H are schematic cross-sectional views of a method for manufacturing an electron-emitting device according to an embodiment of the present invention.

First, a niobium cathode electrode 2, an insulating silicon dioxide layer 70 (having a thickness of approximately 1 μm), and an electroconductive niobium layer 80 were sequentially formed on a glass substrate 1 (FIG. 3A).

Figure 3B:
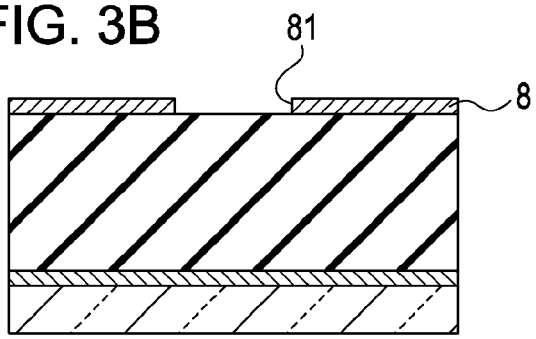

A circular opening 81 having a diameter of approximately 1 μm was formed in the electroconductive niobium layer 80 by ion etching to form a gate electrode 8 (FIG. 3B).

Figure 3C:
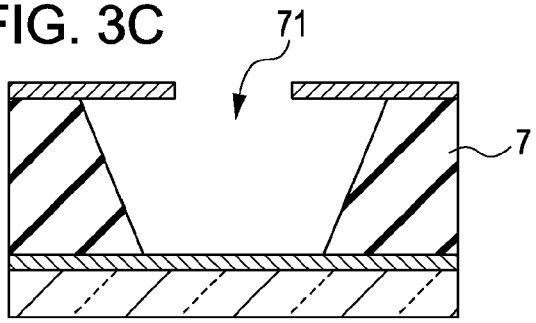

The insulating silicon dioxide layer 70 was etched or ion-etched using the gate electrode 8 as a mask to form an insulating layer 7 having a circular opening 71 (FIG. 3C).

Figure 3D:
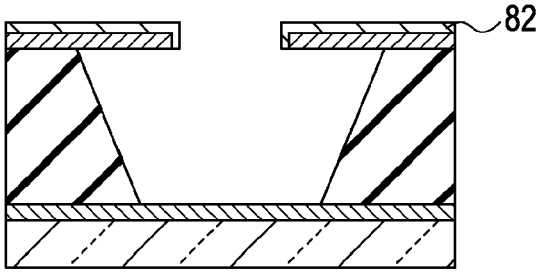

A sacrificial nickel layer 82 was then formed on the gate electrode 8 (FIG. 3D).

Figure 3E:
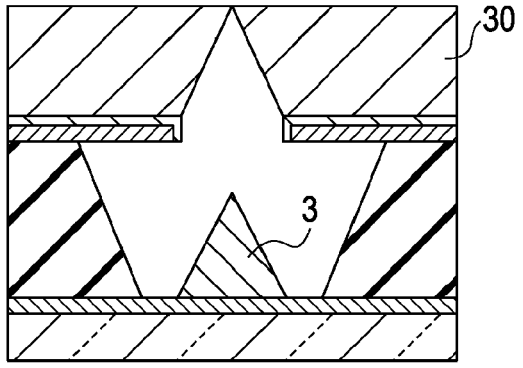

A conical molybdenum structure 3 was formed in the opening 71 (FIG. 3E).

Figure 3F:
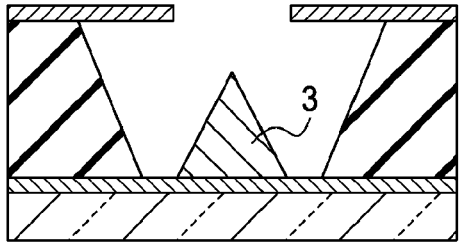

A molybdenum layer 30 on the sacrificial nickel layer 82 was removed together with the sacrificial nickel layer 82 (FIG. 3F).

Figure 3G:
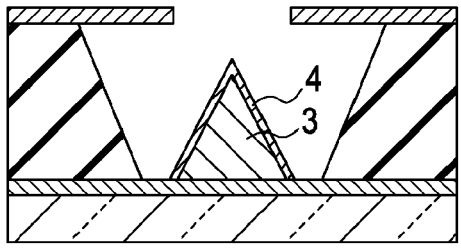

The substrate 1 on which the structure 3 had been formed as illustrated in FIG. 3F was placed in a vacuum chamber. A molybdenum oxide layer 4 having a thickness of approximately 4 nm was formed on the structure 3 by sputtering using a molybdenum oxide target (FIG. 3G).

Figure 3H:
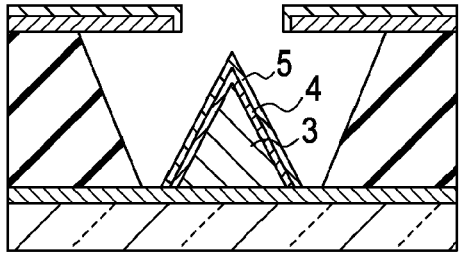

A polycrystalline lanthanum hexaboride layer 5 having a thickness of 10 nm was formed on the oxide layer 4 by RF sputtering, thus completing an electron-emitting device according to the present example (FIG. 3H). The RF sputtering was performed at an Ar pressure of 1.5 Pa and a RF power of 250 W. The polycrystalline layer 5 had a crystallite size of 7 nm and a work function of 2.85 eV. As illustrated in FIG. 3H, a polycrystalline hexaboride layer having the same properties as the polycrystalline lanthanum hexaboride layer 5 is formed on the gate electrode 8. This hexaboride layer may be left on or removed from the gate electrode 8. To remove the hexaboride layer, for example, after a mask is formed on the lanthanum hexaboride layer 5, the hexaboride layer on the gate electrode 8 is etched. Alternatively, for example, in the step illustrated in FIG. 3D, in addition to the sacrificial nickel layer 82, another sacrificial layer may be formed, and the hexaboride layer may be removed together with that another sacrificial layer.

The crystallite size could be controlled by appropriately determining the sputtering conditions, particularly Ar pressure and RF power. For example, at an Ar pressure of 2.0 Pa, a RF power of 800 W, and a film thickness of 7 nm, the crystallite size was 2.5 nm and the work function was 2.85 eV. At an Ar pressure of 1.5 Pa, a RF power of 250 W, and a film thickness of 20 nm, the crystallite size was 10.7 nm and the work function was 2.8 eV. Under deposition conditions for forming a film having a thickness of 7 nm, the integrated intensity ratio $I_{(100)}/I_{(110)}$ of X-ray diffraction peaks was 0.54, which agreed well with a value observed in the absence of orientation (JCPDS#34-0427). This demonstrates that the lanthanum boride layer 5 prepared in the present example was a non-oriented polycrystalline layer. The orientation of a plane corresponding to a (100) diffraction peak proceeded with an increase in film thickness. At a film thickness above 20 nm, typically 30 nm or more, $I_{(100)}/I_{(110)}$ was more than 2.8. At a film thickness of 20 nm or less, the integrated intensity of any plane orientation other than (100) or (110) was lower than the integrated intensities of the (100) and (110) plane orientations. The crystallite size increased with increasing film thickness. The work function was more than 3.0 eV at a crystallite size below 2.5 nm. This is probably because the crystallite size is too small to maintain crystallinity.

The fabricated electron-emitting device was placed in a vacuum apparatus, which was then evacuated to $10^{-8}$ Pa. Rectangular pulse voltages were repeatedly applied between the cathode electrode 2 and the gate electrode 8 at a pulse width of 6 ms and a frequency of 25 Hz. The gate electrode 8 had a higher electric potential than the cathode electrode 2. A gate current passing through the gate electrode 8 was monitored. An anode plate was installed at 5 mm above the substrate 1. An electric current flowing into the anode (anode current) was also monitored to measure changes in emission current. To measure changes (fluctuations) in emission current, a sequence of measuring the mean emission current (anode current) in response to 32 successive rectangular pulse voltages was performed at intervals of 2 seconds, and the deviation and the mean emission current are obtained per 30 minutes. (Standard deviation/mean emission current×100 (%)) was calculated as the fluctuations from the measured data.

For comparison purposes, an electron-emitting device having no molybdenum oxide layer 4 between the structure 3 and the polycrystalline lanthanum hexaboride layer 5 was also evaluated in the same manner.

A plurality of electron-emitting devices according to the present example and a plurality of comparative electron-emitting devices were evaluated as described above. The mean value of changes in electric current for the electron-emitting device having the molybdenum oxide layer 4 was 0.6 times that for the comparative electron-emitting device having no oxide layer. The variance in electric current among the electron-emitting devices according to the present example was 0.5 times the variance in electric current among the comparative electron-emitting devices.

These results clearly show that the molybdenum oxide layer 4 can decrease changes in electric current and the variance in electric current among the electron-emitting devices, allowing a stably operable electron-emitting device to be fabricated.

Example 2

The present example describes an electron-emitting device including a structure 3 formed of tungsten. The processes up to the process of forming the sacrificial nickel layer 82 on the gate electrode 8 (FIG. 3D) were performed as in Example 1.

Subsequently, a conical tungsten structure 3 was formed in the opening 71 (FIG. 3E). A tungsten layer 30 deposited on the sacrificial layer 82 was removed together with the sacrificial layer 82 (FIG. 3F).

The substrate 1 on which the structure 3 had been formed as illustrated in FIG. 3F was placed in a vacuum chamber. A tungsten oxide layer 4 having a thickness of approximately 4 nm was formed on the structure 3 by sputtering using a tungsten oxide target (FIG. 3G).

As described in Example 1, a polycrystalline lanthanum hexaboride layer 5 having a thickness of 10 nm was formed on the oxide layer 4 by sputtering, thus completing an electron-emitting device according to the present example (FIG. 3H).

The electron-emitting device was placed in a vacuum apparatus, and changes in anode emission current were measured, as described in Example 1. For comparison purposes, an electron-emitting device having no oxide layer 4 between the structure 3 and the polycrystalline $LaB_6$ layer 5 was also evaluated in the same manner.

The mean value of changes in electric current for the electron-emitting device having the tungsten oxide layer 4 was 0.7 times that for the comparative electron-emitting device having no oxide layer 4. The variance in electric current among the electron-emitting devices according to the present example was 0.6 times the variance in electric current among the comparative electron-emitting devices. These results clearly show that the tungsten oxide layer 4 can decrease changes in electric current and the variance in electric current among the electron-emitting devices, thus providing a stably operable electron-emitting device.

Example 3

In the present example, a molybdenum oxide layer 4 of an electron-emitting device formed as in Example 1 further contained La.

As in the process illustrated in FIG. 3G of Example 1, an oxide layer 4 having a thickness of 6 nm was formed by sputtering using a target that contained molybdenum oxide and lanthanum. The other processes were the same as in Example 1. An XPS analysis of the fabricated electron-emitting device showed that the atomic concentration of La in the oxide layer 4 was 10% and indicated the presence of lanthanum and an oxide of lanthanum. The oxide layer 4 further contained $MoO_2$.

The electron-emitting device according to the present example initiated electron emission at a lower voltage than the electron-emitting device according to Example 1.

Another electron-emitting device was fabricated by sequentially forming a molybdenum oxide layer containing La and a polycrystalline $LaB_6$ layer on a molybdenum layer disposed on a flat substrate in the same manner as described in the present example. For comparison purposes, another electron-emitting device was fabricated by sequentially forming a molybdenum oxide layer free of La and a polycrystalline $LaB_6$ layer in the same way as in Example 1. The electron-emitting device having the molybdenum oxide layer containing La had at least one order of magnitude lower resistance in the thickness direction than the electron-emitting device having the molybdenum oxide layer free of La. This result suggests that La in the molybdenum oxide layer 4 decreased the resistance of the electron-emitting device, thereby decreasing the voltage at which electron emission was initiated.

Example 4

In the present example, a tungsten oxide layer 4 of an electron-emitting device formed as in Example 2 further contained La.

As in the process illustrated in FIG. 3G of Example 2, an oxide layer 4 having a thickness of 6 nm was formed by sputtering using a target that contained tungsten oxide and lanthanum. The other processes were the same as in Example 2. An XPS analysis of the fabricated electron-emitting device showed that the atomic concentration of La in the oxide layer 4 was 10% and that the oxide layer 4 contained lanthanum and an oxide of lanthanum. The oxide layer 4 further contained $WO_2$.

The electron-emitting device according to the present example initiated electron emission at a lower voltage than the electron-emitting device according to Example 2.

Another electron-emitting device was fabricated by sequentially forming a tungsten oxide layer containing La and a polycrystalline $LaB_6$ layer on a tungsten layer disposed on a flat substrate in the same manner as described in the present example. For comparison purposes, another electron-emitting device was fabricated by sequentially forming a tungsten oxide layer free of La and a polycrystalline $LaB_6$ layer in the same way as in Example 2. The electron-emitting device having the tungsten oxide layer containing La had at least one order of magnitude lower resistance in the thickness direction than the electron-emitting device having the tungsten oxide layer free of La. This result suggests that La in the tungsten oxide layer 4 decreased the resistance of the electron-emitting device, thereby decreasing the voltage at which electron emission was initiated.

Example 5

The present example describes an electron-emitting device in which a lanthanum oxide layer 6 was formed on the polycrystalline $LaB_6$ layer 5 of the electron-emitting device according to Example 3.

The processes up to the process of forming the polycrystalline $LaB_6$ layer 5 (FIG. 3H) were performed as in Example 3. Subsequently, a $La_2O_3$ layer having a thickness of approximately 3 nm was formed on the polycrystalline $LaB_6$ layer 5 by sputtering, thus completing an electron-emitting device according to the present example.

The mean value of changes in electric current for the electron-emitting device according to the present example was 0.7 times that for the electron-emitting device according to Example 3. The variance in electric current among the electron-emitting devices according to the present example was 0.7 times the variance in electric current among the electron-emitting devices according to Example 3.

The lanthanum oxide layer 6 on the polycrystalline $LaB_6$ layer 5 can decrease changes in electric current and the variance in electric current among the electron-emitting devices, allowing a stably operable electron-emitting device to be fabricated. As in the present example, the formation of the lanthanum oxide layer 6 on the polycrystalline $LaB_6$ layer 5 of the electron-emitting devices according to Examples 1, 2, and 4 improved the stability of the electron-emitting devices, as compared with the electron-emitting devices having no lanthanum oxide layer 6.

Example 6

The present example describes a method for fabricating the electron-emitting device 10 illustrated in FIG. 5. As materials for a first insulating sublayer 7*a* and a second insulating sublayer 7*b*, silicon nitride and silicon oxide were deposited on a substrate 1. Tungsten was then deposited on the second insulating sublayer 7*b* as a material for a gate electrode 8. Photolithography and dry etching of these materials formed the first insulating sublayer 7*a* and the gate electrode 8 described in FIG. 5B. The first insulating sublayer 7*a* had an inclined side surface 171. The silicon oxide layer was selectively wet-etched to form the second insulating sublayer 7*b* and a depression 7*c*.

Molybdenum was then deposited on the side surface 171 of the first insulating sublayer 7*a* by sputtering. Molybdenum extended into the depression 7*c* over the top surface 172 of the first insulating sublayer 7*a* to form a structure 3 having a projection toward the gate electrode 8*a*. At the same time, a molybdenum gate electrode 8*b* was formed on the gate electrode 8*a*.

As described in Example 1, a molybdenum oxide layer 4 was then formed on the structure 3 by sputtering using a molybdenum oxide target. A polycrystalline lanthanum boride layer 5 was formed on the molybdenum oxide layer 4 under the conditions described in Example 1.

In this way, 200 strips of electron-emitting members 9 were formed on the substrate 1 at 3 μm intervals in the Y direction in FIG. 5C. Finally, a niobium cathode electrode 2 was formed to be connected to the electron-emitting members 9.

When a voltage was applied between the cathode electrode 2 and the gate electrode 8 such that the gate electrode 8 had a higher electric potential than the cathode electrode 2, the electron-emitting device 10 exhibited excellent electron emission characteristics. A voltage at which electron emission was observed was lower in the present example than in Example 1.

As described in Example 3, using a target of molybdenum oxide containing lanthanum in the formation of the molybdenum oxide layer 4 allowed electron emission to occur at a lower voltage than using a target of molybdenum oxide free of lanthanum.

As described in Example 5, when a lanthanum oxide layer was formed on the polycrystalline lanthanum boride layer 5 by sputtering, the electron-emitting device 10 had stable electron emission characteristics for a long period of time.

Example 7

The present example describes the fabrication of an image display apparatus illustrated in FIG. 8 using the electron-emitting device according to Example 3. The image display apparatus was a 50-inch flat-panel display having 1920 pixels in the horizontal direction and 1080 pixels in the vertical direction.

As illustrated in FIG. 7, a large number of electron-emitting devices according to Example 3 were arranged on a cathode substrate to fabricate an electron source 32. The electron source 32 was used as a rear plate. A face plate 31 that included a light-emitting layer 25 and an anode 21 disposed on the light-emitting layer 25 was prepared. The light-emitting layer 25 included a large number of fluorescent members. A frame 27 was hermetically bonded to the face plate 31 and the rear plate 32 to maintain a distance of 2 mm therebetween. The bonding was performed in a vacuum. Through these processes, an display panel 100 having a vacuum interior was fabricated (FIG. 8).

The display panel 100 was connected to a drive circuit 110 and other components to fabricate an image display apparatus illustrated in FIG. 9. Application of pulse voltages to selected electron-emitting devices displayed a bright high-quality image with small changes in luminance for a long period of time.

An image display apparatus that included the electron-emitting device according to Example 5 displayed a bright high-quality image with small changes in luminance for a longer period of time than the image display apparatus including the electron-emitting device according to Example 3.

An image display apparatus that included the electron-emitting device according to Example 6 was also a high-quality image display apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-307585 filed Dec. 2, 2008 and No. 2009-233503 filed Oct. 7, 2009, which are hereby incorporated by reference herein in their entirety.

What is claimed is:

1. An electron-emitting device that includes an electron-emitting member and emits electrons from a surface of the electron-emitting member in an electric field, the electron-emitting member including an electroconductive member and a lanthanum boride layer disposed on the electroconductive member, wherein an oxide layer is disposed between the electroconductive member and the lanthanum boride layer, and wherein the electroconductive member is formed of molybdenum and the oxide layer contains an oxide of molybdenum and an oxide of lanthanum, or the electroconductive member is formed of tungsten and the oxide layer contains an oxide of tungsten and an oxide of lanthanum.

2. The electron-emitting device according to claim 1, wherein the oxide layer contains a lanthanum element.

3. The electron-emitting device according to claim 1, wherein the electron-emitting member includes a lanthanum oxide layer disposed on the lanthanum boride layer.

4. The electron-emitting device according to claim 2, wherein the electron-emitting member includes a lanthanum oxide layer disposed on the lanthanum boride layer.

5. The electron-emitting device according to claim 1, wherein the lanthanum boride layer is a polycrystalline lanthanum boride layer.

6. An electron-emitting device that includes an electroconductive member and a lanthanum boride layer disposed on the electroconductive member, wherein an oxide layer is disposed between the electroconductive member and the lanthanum boride layer, and the oxide layer contains a lanthanum element, and wherein the electroconductive member is formed of molybdenum and the oxide layer contains an oxide of molybdenum and an oxide of lanthanum, or the electroconductive member is formed of tungsten and the oxide layer contains an oxide of tungsten and an oxide of lanthanum.

7. The electron-emitting device according to claim 6, wherein a lanthanum oxide layer is disposed on the lanthanum boride layer.

8. The electron-emitting device according to claim 6, wherein the lanthanum boride layer is a polycrystalline lanthanum boride layer.

9. The electron-emitting device according to claim 6, wherein the electron-emitting device further includes an insulating layer having a top surface and a side surface in contact with the top surface, and a gate electrode disposed on the insulating layer, wherein the electroconductive member extends from the side surface to the top surface.

10. A display panel comprising:

a plurality of electron-emitting devices; and a light-emitting member that emits light in response to irradiation with electrons from the electron-emitting devices, each of the electron-emitting devices being the electron-emitting device according to claim 6.

11. An information display system comprising:

an information-processing circuit for receiving an information signal; and a display panel according claim 10 which displays an information contained in the information signal.

12. An electron-emitting device that includes an electroconductive member and a lanthanum boride layer disposed on the electroconductive member, wherein an oxide layer is disposed between the electroconductive member and the lanthanum boride layer, and a lanthanum oxide layer is disposed on the lanthanum boride layer.

13. The electron-emitting device according to claim 12, wherein the lanthanum oxide layer is formed of dilanthanum trioxide.

14. The electron-emitting device according to claim 12, wherein the lanthanum boride layer is a polycrystalline lanthanum boride layer.

15. The electron-emitting device according to claim 12, wherein the electroconductive member is formed of molybdenum and the oxide layer contains an oxide of molybdenum and an oxide of lanthanum, or the electroconductive member is formed of tungsten and the oxide layer contains an oxide of tungsten and an oxide of lanthanum.

16. The electron-emitting device according to claim 12, wherein the electron-emitting device further includes an insulating layer having a top surface and a side surface in contact with the top surface, and a gate electrode disposed on the insulating layer, wherein the electroconductive member extends from the side surface to the top surface.

17. A display panel comprising:

a plurality of electron-emitting devices; and a light-emitting member that emits light in response to irradiation with electrons from the electron-emitting devices, each of the electron-emitting devices being the electron-emitting device according to claim 12.

18. An information display system comprising:

an information-processing circuit for receiving an information signal; and a display panel according claim 17 which displays an information contained in the information signal.

* * * * *